US005708466A

United States Patent [19]

Noguchi

[11] Patent Number: 5,708,466

[45] Date of Patent: Jan. 13, 1998

[54] INK JET HEAD HAVING PARALLEL LIQUID PATHS AND PRESSURE-DIRECTING WALL

[75] Inventor: Hiromichi Noguchi, Atsugi, Japan

[73] Assignee: Canon Kabushiki Kaisha, Tokyo, Japan

[21] Appl. No.: 458,700

[22] Filed: Jun. 2, 1995

Related U.S. Application Data

[63] Continuation of Ser. No. 291,840, Aug. 17, 1994, abandoned, which is a continuation of Ser. No. 929,923, Aug. 17, 1992, abandoned, which is a division of Ser. No. 905,124, Jun. 24, 1992, abandoned, which is a continuation of Ser. No. 681,401, Apr. 4, 1991, abandoned, which is a continuation of Ser. No. 367,326, Jun. 16, 1989, abandoned.

[30] Foreign Application Priority Data

Jun. 21, 1988 [JP] Japan ..... 63-151084

[51] Int. Cl.[6] ..... B41J 2/05

[52] U.S. Cl. ..... 347/65

[58] Field of Search ..... 347/65, 63, 64, 347/56

[56] References Cited

U.S. PATENT DOCUMENTS

| | | | |
|---|---|---|---|
| 4,095,237 | 6/1978 | Amberntsson . | |
| 4,104,646 | 8/1978 | Fischbeck . | |
| 4,330,787 | 5/1982 | Sato et al. | 347/63 |
| 4,338,611 | 7/1982 | Eida et al. . | |
| 4,383,263 | 5/1983 | Ozawa et al. . | |
| 4,392,145 | 7/1983 | Parkola | 347/40 |
| 4,394,670 | 7/1983 | Sugitani | 347/65 |
| 4,459,600 | 7/1984 | Sato et al. . | |
| 4,528,575 | 7/1985 | Matsuda | 347/40 |
| 4,542,391 | 9/1985 | Miyagawa . | |
| 4,723,136 | 2/1988 | Suzumura . | |
| 4,771,298 | 9/1988 | Lee et al. . | |
| 4,774,530 | 9/1988 | Hawkins . | |
| 4,897,674 | 1/1990 | Hirasawa . | |
| 4,963,883 | 10/1990 | Matsui . | |

FOREIGN PATENT DOCUMENTS

| | | |
|---|---|---|
| 3539095 | 5/1986 | Germany . |
| 2092960 | 8/1982 | United Kingdom . |

*Primary Examiner*—Joseph W. Hartary
*Attorney, Agent, or Firm*—Fitzpatrick, Cella, Harper & Scinto

[57] ABSTRACT

An ink jet head includes a first liquid path, the end of which defines a discharge port through which ink is ejected, and a second liquid path having a discharge energy generating element for generating energy to be used for discharging the ink through the discharge port, the discharge energy generating element including a heat generating element for applying heat to discharge ink, the discharge energy generating element generating pressure when driven. The first liquid path is in fluid communication with the second fluid path in the vicinity of the discharge energy generating element, and the first and second liquid paths are substantially parallel to one another. A wall is disposed at least partially above the discharge energy generating element, this wall having a slanted surface which guides the pressure above the discharge energy generating element generated when the discharge energy generating element is driven into the first liquid path and toward the discharge port. At least a portion of the first liquid path is located above the discharge energy generating element and is remote from the second liquid path.

1 Claim, 6 Drawing Sheets

INK JET HEAD HAVING PARALLEL LIQUID PATHS AND PRESSURE-DIRECTING WALL

This application is a continuation of application Ser. No. 08/291,840 filed Aug. 17, 1994 which was a continuation of application Ser. No. 07/929,923 filed Aug. 17, 1992, which was a division of application Ser. No. 07/905,124 filed Jun. 24, 1992, which was a continuation of application Ser. No. 07/681,401 filed Apr. 4, 1991, which was a continuation of application Ser. No. 07/367,326 filed Jun. 16, 1989, all now abandoned.

BACKGROUND OF THE INVENTION

1. Field of the Invention

This invention relates to a recording head for use in an ink jet recording apparatus which discharges ink and forms droplets of the ink and causes them to adhere to a recording medium such as paper to thereby accomplish recording.

2. Related Background Art

The ink jet recording method is a recording method whereby ink (recording liquid) is discharged from an orifice provided in a recording head to form ink droplets, which are caused to adhere to a recording medium such as paper to thereby accomplish recording, and this method has numerous advantages such as very little noise occurs, high-speed recording is possible and it is not necessary to use any other recording paper of special construction than plain paper, and thus various types of recording heads have been developed.

Now, in conformity with the widened range of application of the ink jet recording method such as the application thereof to the high-speed recording of images of high quality, higher-degree performances such as stable discharge of ink droplets, accuracy of the shot position of ink droplets on the recording medium, response frequency to a recording signal, and flying speed of ink droplets are being required of the ink jet recording head, and the desire for lower costs is also strong.

However, the conventional recording heads could not always be said to satisfy these requirements sufficiently.

For example, in a recording head having a construction as shown in FIGS. 1A and 1B of the accompanying drawings, if various portions are formed of the materials and by the forming method as described above, it will lead to the advantage that it is very easy to make various portions accurately minute and make the discharge port multiplicate or compact and that high mass productivity is obtained, but in some cases, the direction of discharge of ink droplets from the discharge port is liable to be disturbed and the quality of printing is deteriorated. Also, there have been limits in the reponse frequency and the flying speed of ink droplets during ink discharge.

That is, it is often the case that the materials used for a base plate 1, a wall member 2 and a top plate 3 constituting the recording head usually differ from one another from the viewpoint of the functions and workability of these portions. As a result, the wettability and surface smoothness of that portion of a discharge port 5 around the opening end surface 1*a* of the discharge port 5 and in the ceiling, side wall and bottom of the portion constituting the discharge port 5 partially differ. When ink is discharged from the discharge port 5, that portion of the discharge port 5 around the opening end surface 1*a* of the discharge port becomes non-uniformly wet with the ink, and for example, when the wettability of the surface constituted by the base plate 1 is high as compared with that of the other portions, the direction of discharge of the ink is disturbed toward the base plate 1 as shown in FIG. 2 of the accompanying drawings, and deviation of the shot point of an ink droplet onto the recording medium occurs.

Also, due to the construction in which, as indicated by a dot-and-dash line 14*b* in FIG. 1B, the center line of the liquid path and the opening center axis of the discharge port are on the same straight line, there are also limits in the ink droplet formation by discharge energy and the rate of conversion of the discharge energy into the flying speed of an ink droplet.

So, as a means for solving the problem based on the construction of the discharge port, there has been attempted a process of coating the opening end surface 1*a* of the discharge port with the same material which intends to homogenize the quality of the material of the opening end surface 1*a*.

Regarding coating process, mention may be made for example, of a method of coating with a metal evaporated film, a method of coating with a setting resin having an ink-repelling property and setting the resin, a method of coating with a resin having an ink-repelling material dispersed therein, a method of transferring a photopolymerization type resin and coating with same, or a method of coating with an organic thin film by plasma polymerization.

However, these methods are not always satisfactory in that the apparatus and materials used are expensive or the steps of process are complex and the manufacturing cost is high or in respect of the quality and yield of the product, and these methods are difficult to put into practical use.

On the other hand, as a recording head which intends to solve the problem based on the positional relation between the discharge port and the liquid path, there is known a recording head of a construction as shown in FIG. 3 of the accompanying drawings wherein a discharge port is provided in a top plate 3 and the direction of flow of ink to a discharge energy acting portion in a liquid path 4 and the opening center axis of the discharge port 5 are made perpendicular to each other as indicated by a dot-and-dash line 14*c* (U.S. Pat. No. 4,459,600).

By adopting such a construction, the problem based on the difference in the material forming the discharge port 5 as mentioned above can be eliminated and moreover, the energy from a discharge energy generating member 7 can be efficiently used for the formation of ink droplets and converted into the flying energy thereof, and this also leads to the structural advantage that the return of meniscus by the supply of ink is quick, which in turn is particularly effective in a case where a heat generating element is used as the discharge energy generating member.

However, where minute discharge ports are arranged highly densely, particularly, where color recording is intended, it tends to become difficult as compared with the type shown in FIGS. 1A and 1B to dispose the discharge ports for respective colors in proximity to one another. Accordingly, in some cases, such construction cannot be said to be the best suited form when the requirement for the compactness of the apparatus is taken into account.

So, the provision of a recording head having the merits of the above-described two types is desired.

SUMMARY OF THE INVENTION

It is an object of the present invention to provide an ink jet recording head which can satisfy the various required performances as mentioned above.

It is a specific object of the present invention to provide an ink jet recording head in which the ink wettability and smoothness of the portions constituting a discharge port are made uniform, whereby good accuracy of the shot position of an ink droplet discharged from the discharge port onto a recording medium can be provided to thereby consistently obtain images of high quality for a long period of time.

It is also an object of the present invention to provide an ink jet recording head in which energy from a discharge energy generating member can be caused to act efficiently on ink, whereby a higher response frequency and a higher flying speed of ink droplets can be obtained.

It is a further object of the present invention to provide an ink jet recording head which can be manufactured at a lower cost by a simple process.

It is also an object of the present invention to provide an ink jet recording head having a discharge port for discharging ink therethrough, a liquid path communicating with said discharge port and having a portion in which the energy for ink discharge acts on the ink, and a discharge energy generating member generating the energy for ink discharge and wherein said liquid path and said discharge port are provided so that a portion for prescribing the flow of ink to said discharge energy acting portion of said liquid path and the opening center axis of said discharge port are not on the same straight line but are parallel to each other, and said discharge port is formed of the same material.

Still another object of this invention is to provide an ink jet head having a first liquid path, the end of which defines a discharge port through which ink is ejected and a second liquid path having a discharge energy generating element for generating energy to be used for discharging the ink through the discharge port, the discharge energy generating element including a heat generating element for applying heat to discharge ink, the discharge energy generating element generating pressure when driven. The first liquid path is in fluid communication with the second fluid path in the vicinity of the discharge energy generating element, and the first and second liquid paths are substantially parallel to one another. A wall is disposed at least partially above the discharge energy generating element, this wall having a slanted surface which guides the pressure above the discharge energy generating element generated when the discharge energy generating element is driven into the first liquid path and toward the discharge port. At least a portion of the first liquid path is located above the discharge energy generating element and is remote from the second liquid path.

DESCRIPTION OF THE PREFERRED EMBODIMENTS

The recording head of the present invention has a construction in which the center line of a portion forming the flow of ink to a portion in which the discharge energy of a liquid path acts on the ink (a discharge energy acting portion) and a discharge port having a center axis parallel to said center line are typically connected together by a crank-shaped bent portion and which is suitable for more efficiently converting the energy from a discharge energy generating member into kinetic energy for the formation and flying of ink droplets and obtaining a higher response frequency and a higher ink droplet flying speed.

Moreover, the portions constituting a discharge port are formed of the same material and therefore, the ink wettability and smoothness of that portion of the discharge port around the opening end surface of the discharge port become uniform and thus, the deviation of the direction of discharge of the ink as previously mentioned can be prevented and good accuracy of the shot position of the ink can be obtained.

Further, the recording head of the present invention, in its structure, employ a heat generating element as the discharge energy generating member, and can utilize the thin film forming technique and the semiconductor lithography technique as previously described for the formation of the heat generating element and the electrode wiring to said element, and can also utilize the photolithography technique using a photosensitive resin for the formation of the discharge port and the ink liquid path and therefore, it is very easy to make various portions minute highly accurately and make the discharge port multiplicate, and it is possible to make the recording head compact and excellent in mass productivity.

The present invention will hereinafter be described in greater detail with reference to the drawings.

Figure 4A:
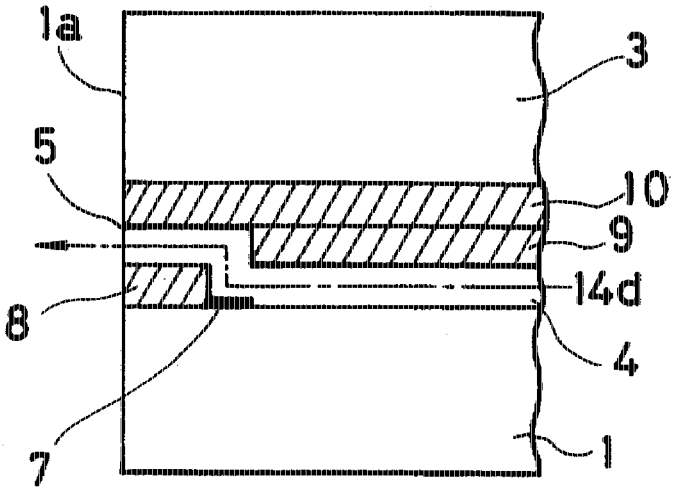
FIG. 4A is a schematic cross-sectional view of the main portion of an embodiment of the recording head of the present invention.
Figure 4B:
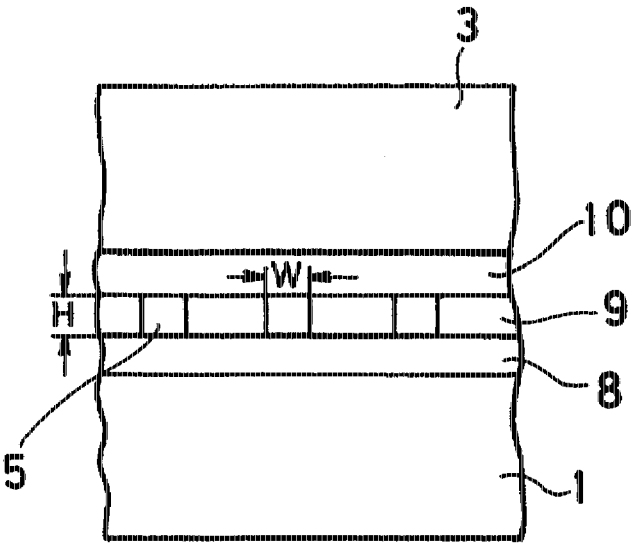
FIG. 4B is a schematic fragmentary front view of the opening end surface of the discharge port of the recording head shown in FIG. 4A.

FIG. 4A is a schematic cross-sectional view of the main portion of an embodiment of the ink jet recording head of the present invention in which ink droplets are formed, and FIG. 4B is a schematic front view of the opening end surface of the discharge port.

As the ink discharge system in this ink jet recording method, there is typically known a method which utilizes a continuous droplet formed by a change in the pressure in a liquid path caused by the deformation of a piezo-electric element, a system in which a piezo-electric element for generating mechanical energy is used as an ink discharge energy generating member, or a system as shown in Japanese Laid-Open Patent Application No. 53-101189 wherein a heat generating element is provided in a liquid path and ink is suddenly heated by heat energy generated by the heat generating element and a liquid droplet is discharged by the force of a resultant bubble, that is, a heat generating element is used as an ink discharge energy generating member.

In a recording head using the ink discharge system which utilizes a heat generating element as an ink discharge energy generating member, the thin film forming technique and the semiconductor lithography technique can be utilized for the formation of the heat generating element and the electrode wiring to the element and the photolithography technique using photosensitive resin can be utilized for the formation of the discharge port and the ink flow path, and this leads to the advantage that it is very easy to make various portions accurately minute and make the discharge port multiplicate or compact, as well as the advantage of the excellence in mass productivity.

Figure 1A:
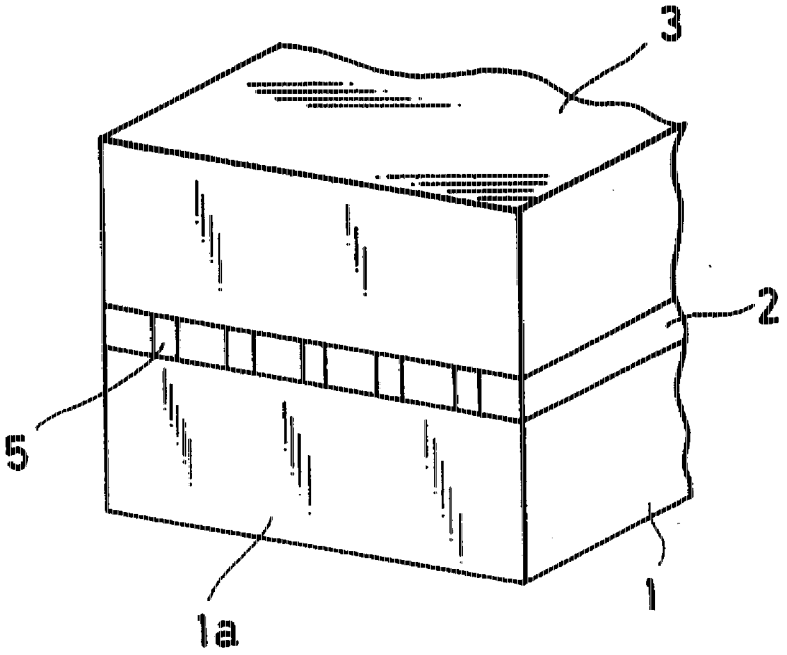
FIG. 1A PRIOR ART
FIGS. 1A and 1B are a schematic perspective view and a schematic cross-sectional view, respectively, of the main portion of a recording head according to the prior art.
Figure 1B:
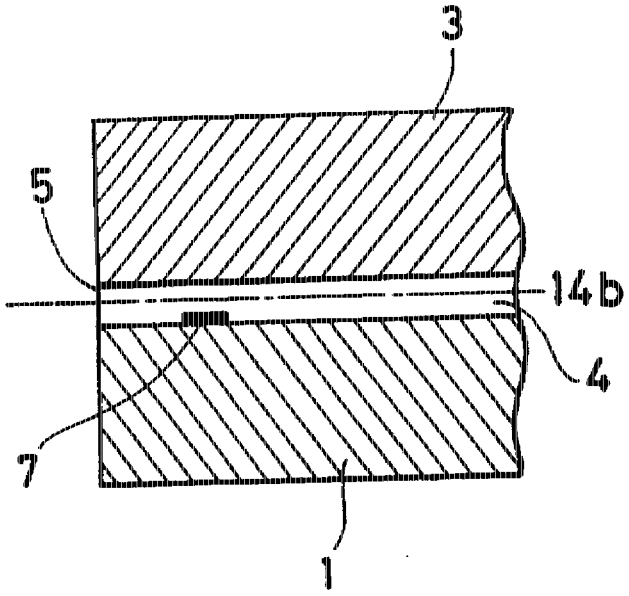
FIG. 1B PRIOR ART

A typical example of the construction of the main portion of a prior-art recording head used in such an ink jet recording method is schematically shown in FIGS. 1A and 1B.

This recording head has a construction in which a wall member 2 constituting the side wall of a liquid path and a discharge port 5 is provided on a base plate 1 having a discharge energy generating member 7 as described above (an electrode for applying a discharge signal to said generating member and a protective layer provided on said generating member as required are not shown) and a top plate 3 constituting the cover of a liquid path 4 is provided on the wall member 2.

In this recording head, when a recording signal is applied to the discharge energy generating member 7 through an electrode, not shown, with ink being supplied to the liquid path 4 from a liquid chamber (not shown) in which ink is stored, discharge energy generated from the generating member 7 acts on the ink in the liquid path 4 above the discharge energy generating member 7 (the discharge energy acting portion) with a result that the ink is discharged as a liquid droplet from the discharge port 5. The thus discharged ink droplet adheres to a recording medium such as paper fed to the front of the discharge port 5.

This recording head has a construction in which the liquid path 4 communicating with the discharge port 5 through a crank-shaped portion upwardly bent on the discharge energy generating member 7 (the discharge energy acting portion) for forming a flow of ink indicated by a dot-and-dash line 14*a* and layers 8, 9 and 10 formed of the same material and constituting the discharge port 5 are provided on the base plate 1 on which the discharge energy generating member 7 is provided.

That is, the center line of that portion of the liquid path 4 which forms the flow of ink onto the discharge energy generating member 7 and the opening center axis of the discharge port are parallel to each other.

The opening center axis of the discharge port in the present invention refers to an axis passing through the center of the discharge port and orthogonal to a plane formed by the opening portion of the discharge port.

With such a construction, the energy generated by the discharge energy generating member 7 can be efficiently transmitted to the downstream side of the discharge energy acting portion (toward the discharge port 5), and a higher response frequency and a higher flying speed of ink droplet can be obtained.

Moreover, the portions constituting the discharge port are formed of the same material and therefore, the ink wettability and smoothness in the portions constituting the discharge port become uniform and thus, stable ink droplet formation and rectilinearity of the direction of flight of ink droplet can be enhanced effectively.

The ink jet recording head of the present invention having such a construction can be manufactured, for example, in the following manner.

First, a layer 8 constituting a portion of the liquid path 4 up to the upper portion of the discharge energy generating member 7 which corresponds to the disposition of the discharge energy generating member 7 and a portion which provides the bottom of the discharge port 5 is provided on the base plate 1 on which are provided the discharge energy generating member 7 and an electrode (not shown) for applying a recording signal to the generating member 7.

The base plate 1 can be obtained by forming the discharge energy generating member and an electrode of Al or like material for applying a recording signal to the generating member on a predetermined portion of the insulative surface of a substrate formed, for example, of silicon wafer, glass, a metal having an insulating layer on its surface, resin film, ceramics or the like, and further providing a protective layer on the discharge energy generating member and the electrode as required.

For example, where a heat generating element is used as the discharge energy generating member, the base plate 1 can be formed by the use of a material usually used for the heat generating element of an ink jet recording head or a material known as a heater material for a thermal head and by a combination of a thick film forming method such as the screen printing method or a thin film forming method such as vacuum evaporation, high frequency sputtering or chemical vapor-phase deposition and a working method using the photolithography technique.

Subsequently, a layer 9 constituting at least the cover portion of the liquid path 4 and the side wall portion of the discharge port 5 and a layer 10 constituting at least the ceiling portion of the discharge port 5 are successively laminated on the layer 8, whereafter a joined member having adhesively secured thereto the top plate 3 formed of a material of high strength such as glass, metal plate, ceramics or resin is further formed on the layer 10.

When this joined member can be intactly used as a recording head, it is the final product.

Also, for example, where the layers 8, 9 and 10 are formed of photosensitive resin, a predetermined location of that portion of the resultant joined member which is downstream of the discharge energy generating member 7 is cut by a dicing saw as required to thereby form the opening end surface of the discharge port, whereby there is provided a recording head.

For the formation of the layers 8, 9 and 10, use can be made, for example, of a method of working the layers 8 and 9 of photosensitive resin into predetermined shapes by the photolithography technique, and further forming the layer 10 of the same photosensitive resin, or a method of using and then sintering a metal plate etched, plated or punched into a predetermined shape, a molded resin plate, cut ceramics or ceramics made into a green sheet, successively laminating the layers 8 and 9 so that they are formed of the same material, and further laminating the layer 10 such as a plate member or the like formed of the same material as the layers 8 and 9, and one of these methods can be suitably chosen in conformity with the desired function and structure of the recording head.

For example, to obtain a more precise recording head higher in the arrangement density of the discharge port 5 and liquid path 4, it is preferable to adopt a method using photosensitive resin readily permitting film thickness control and fine workability and moreover capable of forming layers of good durability.

It is desirable that the layer thicknesses of the layers 8, 9 and 10 be uniform. Also, these layer thicknesses are made sufficient to constitute the portion which is wet in the opening end surface la of the discharge port by the ink when the ink is discharged from the discharge port 5.

Figure 5A:
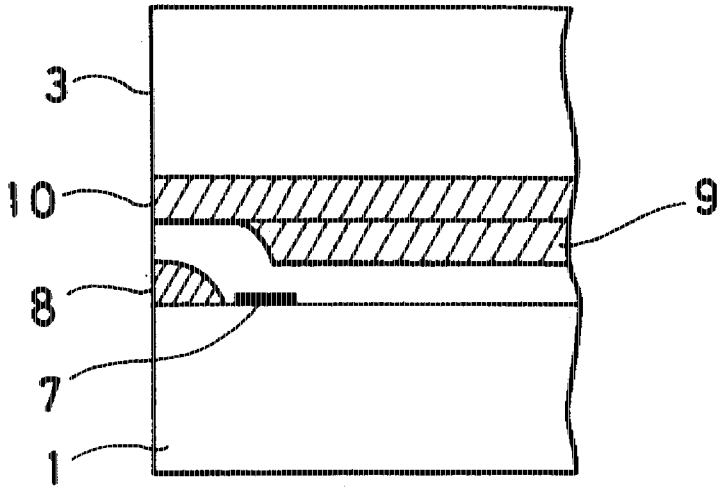
FIGS. 5A and 5B are schematic cross-sectional views of the main portions of further embodiments of the recording head of the present invention.
Figure 5B:
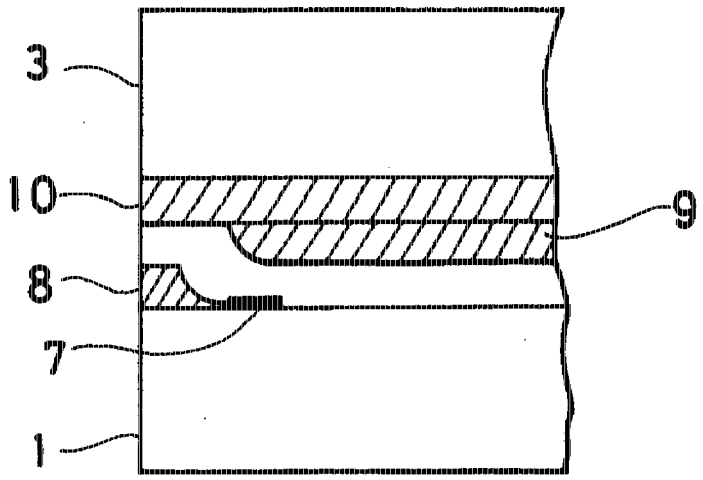

Further, the crooked shape of the liquid path from the vicinity of the discharge energy generating member 7 is not limited to the bent shape as shown in the above-described example, but may assume various forms including the curved shape as shown in FIGS. 5A and 5B.

Also, the layers 8, 9 and 10 may be such that two adjacent layers or all three layers are formed integrally with one another.

In the ink jet recording head of the present invention having the above-described construction, the following typical effects are obtained:

(1) Since the ink wettability and smoothness of the portion constituting the discharge port are uniform, good accuracy of the shot position of ink droplets discharged from the discharge port onto the recording medium is attained and thus, images of high quality can always be obtained for a long period of time;

(2) The energy from the discharge energy generating member can be made to act efficiently on the ink, and a higher response frequency and a higher flying speed of ink droplet can be obtained; and (3) Low-cost manufacture of the recording head is possible by a simple process.

(Embodiments)

The present invention will hereinafter be described in greater detail with respect to embodiments thereof and comparative examples.

Embodiment 1

First, a base plate comprising a heat generating element 7 of $HfB_2$ formed by the evaporation method and the photolithography method and an electrode (not shown) formed of an Al evaporated film provided on a substrate formed of a silicon wafer was formed as a base plate 1.

Subsequently, on the thus obtained base plate, layers 8, 9 and 10 which are hardened layers formed of photosensitive resin were laminated and formed so that the thickness of each layer was 50 μm while dry films VACREL for printed wiring plate (produced by Du Pont de Nemoarce, Inc.) was being worked into respective shapes by the photolithography method, and a Pyrex glass plate as a top plate 3 was adhesively secured onto the layer 10 to form a joined member, whereafter a predetermined portion thereof downstream of the location at which a discharge energy generating member 7 was provided was cut by a dicing saw to form a discharge port 5, whereby the ink jet recording head of the present invention having a construction similar to that shown in FIG. 1 was obtained.

Twenty-four discharge ports 5 were formed at a pitch of 140 μm, and the dimension thereof was: width (W) 50 μm, and height (H) 50 μm.

A number of recording heads were obtained by repeating the above-described operations.

Subsequently, recording tests under the following conditions were carried out by the use of the thus obtained recording heads, and the performances thereof were evaluated with respect to items shown in Table 1 below.

Recording Conditions:

Pulse drive voltage: 24 V

Frequency: 1 KHz

Pulse width: 10 μs

Number of discharge ports discharging at a time: 24

Ink composition: $H_2O$/diethyleneglycol/hood black 2=80/20/4 (part by weight)

Recording medium: paper for bubble jet printer BJ80 (produced by Canon)

Pulse width: $5\times10^7$ (per bit)

Separately from this, the highest drivable frequency (response frequency) and the flying speed of ink droplet were measured, and the results are shown in Table 2 below.

Comparative Example 1

Figure 6A:
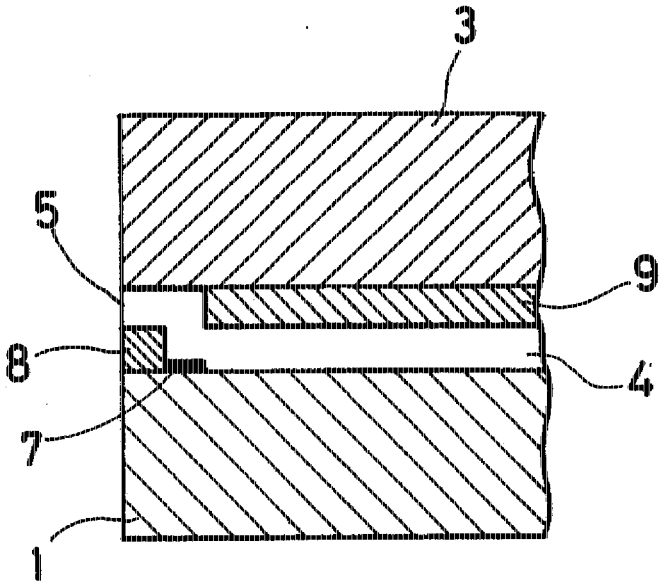
FIG. 6A is a schematic cross-sectional view of the main portion of a recording head formed by Comparative Example 1.
Figure 6B:
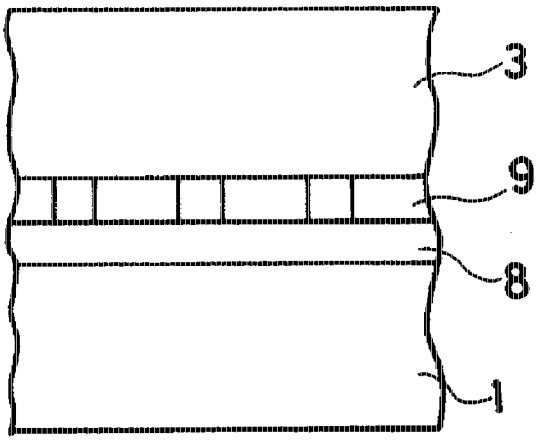
FIG. 6B is a schematic fragmentary front view of the opening end surface of the discharge port of the recording head shown in FIG. 6A.

A number of recording heads were obtained in the same manner as Embodiment 1 with the exception that the top plate 3 was adhesively secured directly onto the layer 9 to thereby provide the structure as shown in FIGS. 6A and 6B.

The result of the evaluation made with respect to the obtained recording heads in the same manner as Embodiment 1 is shown in Tables 1 and 2.

Comparative Example 2

Figure 2:
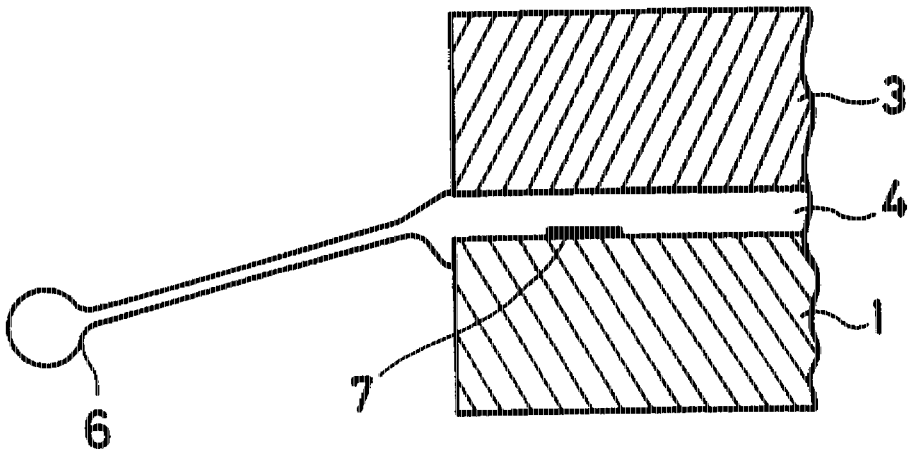
FIG. 2 PRIOR ART
FIG. 2 is a schematic view showing the direction of discharge of ink in the recording head shown in FIGS. 1A and 1B.
Figure 3:
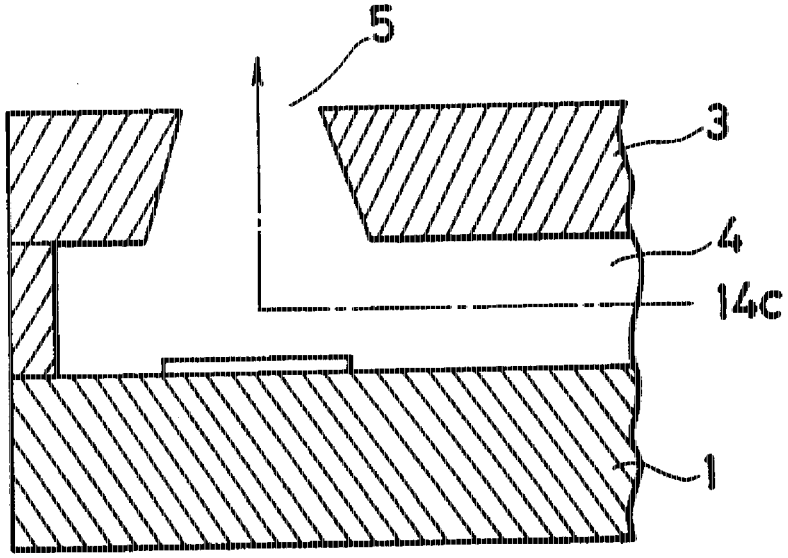
FIG. 3 PRIOR ART
FIG. 3 is a schematic cross-sectional view of the main portion of a prior-art recording head of the type in which an orifice is provided in a top plate.

A number of recording heads were obtained in the same manner as Embodiment 1 with the exception that only the layer 9 was provided on the base plate 1 and the top plate 3 was adhesively secured directly onto the layer 9 to thereby provide the structure as shown in FIG. 2.

The result of the evaluation made with respect to the obtained recording heads in the same manner as Embodiment 1 is shown in Table 1.

TABLE 1

| | Accuracy of shot position judged from printing of vertical and horizontal straight lines | State of ink adherence on the surface of discharge port after printing | Speed of droplet (m/s) |
|---|---|---|---|
| Embodiment 1 | Shot within 40μ around ideal shot position | Small ink droplet only present on the surface of discharge port | 12 |
| Comparative Example 1 | Shot within 150μ around ideal shot position | Wide ink pool seen on the surface of glass | 12 |
| Comparative Example 2 | Shot within 150μ around ideal shot position | Wide ink pool seen on the surface of glass | 8 |

TABLE 2

| | Driving frequency | Speed of droplet |
|---|---|---|
| Embodiment 1 | 5 KHz | 12 m/sec. |
| Comparative Examples | 3 KHz | 8 m/sec. |

As is apparent from the results shown in Tables 1 and 2, the ink jet recording head of the present invention is high in the accuracy of the shot position of ink droplet and makes it difficult for non-uniform wetting of the portions constituting the discharge port to occur. Also, in the recording head of the present invention, higher values were obtained as the highest driving frequency and the flying speed of ink droplet, and it was shown that the structure of the liquid path in the present invention as typically shown in FIG. 1 is effective for efficient utilization of discharge energy.

Embodiment 2

Figure 7A:
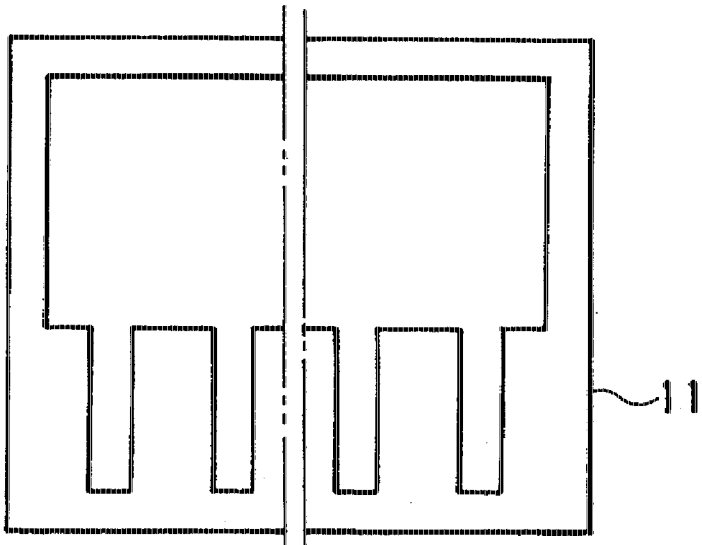
FIGS. 7A, 7B and 7C are partly omitted schematic plan views showing the shapes of laminated plates used in Embodiments 2 and 3.
Figure 7B:
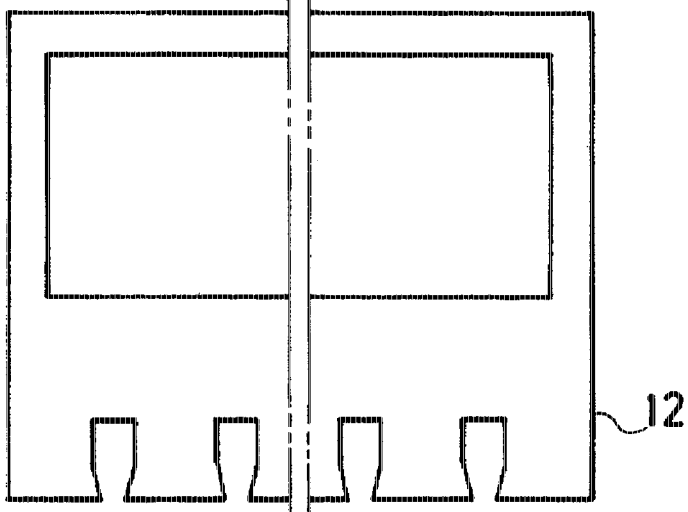
Figure 7C:
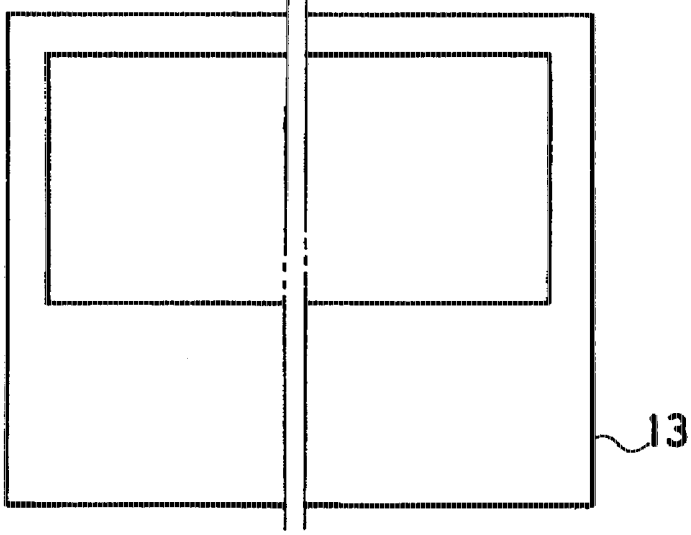

Laminated plates 11, 12 and 13 of the shapes as shown in FIGS. 7A, 7B and 7C formed to a thickness of 30 μm by the Ni electromolding method were layered in the named order on a base plate similar to that used in Embodiment 1, whereby a number of ink jet recording heads of the present invention were obtained.

When the obtained recording heads were tested with respect to the items shown in Table 1 in the same manner as Embodiment 1, a good discharge characteristic similar to that of the recording heads obtained in Embodiment 1 was obtained in all of the obtained recording heads.

Embodiment 3

A number of ink jet recording heads were obtained in the same manner as Embodiment 2 with the exception that laminated plates of polyimide film formed to a thickness of 30 μm and into respective shapes were used as laminated plates 11, 12 and 13.

When the obtained recording heads were tested with respect to the items shown in Table 1 in the same manner as Embodiment 1, a discharge characteristic similar to that of the recording heads obtained in Embodiment 1 was obtained in all of the obtained recording heads.

What is claimed is:

1. An ink jet head comprising:

a first liquid path having an end, said end defining a discharge port through which an ink is ejected; and a second liquid path having a discharge energy generating element for generating energy to be used for discharging the ink through said discharge port, said discharging energy generating element comprising a heat generating element for applying heat so as to discharge the ink, said discharge energy generating element generating a pressure when driven, said first liquid path being in fluid communication with said second fluid path in a vicinity of said discharge energy generating element, said first liquid path and said second liquid path being substantially parallel to one another; and a wall disposed at least partially above said discharge energy generating element, said wall comprising a slanted surface which guides the pressure above said discharge energy generating element that is generated when said discharge energy generating element is driven, said wall guiding the pressure into said first liquid path and toward said discharge port, wherein at least a portion of said first liquid path is located above said discharge energy generating element and is remote from said second liquid path.

* * * * *

UNITED STATES PATENT AND TRADEMARK OFFICE

CERTIFICATE OF CORRECTION

PATENT NO. : 5,708,466

DATED : January 13, 1998

INVENTOR(S) : HIROMICHI NOGUCHI

It is certified that error appears in the above-identified patent and that said Letters Patent is hereby corrected as shown below:

[57] ABSTRACT

Line 9, "second fluid" should read --second liquid--.

COLUMN 2

Line 18, "coating" should read --this coating--.

Line 60, "So," should read --Therefore,--.

COLUMN 3

Line 38, "second fluid" should read --second liquid--.

COLUMN 4

Line 36, "employ" should read --employs--.

COLUMN 7

Line 41, "de Nemoarce," should read --de Nemours,--.

Line 67, "(part" should read --(parts--.

UNITED STATES PATENT AND TRADEMARK OFFICE

CERTIFICATE OF CORRECTION

PATENT NO. : 5,708,466

DATED : January 13, 1998

INVENTOR(S) : HIROMICHI NOGUCHI

It is certified that error appears in the above-identified patent and that said Letters Patent is hereby corrected as shown below:

COLUMN 10

Line 3, "discharg-" should read --discharge--.

Line 4, "ing" should be deleted.

Line 8, "fluid" should read --liquid--.

Signed and Sealed this

Fifteenth Day of September, 1998

Bruce Lehman

*Attest:*

BRUCE LEHMAN

*Attesting Officer*

*Commissioner of Patents and Trademarks*